US005376297A

United States Patent [19]

Choy et al.

[11] Patent Number: 5,376,297

[45] Date of Patent: * Dec. 27, 1994

[54] THICKENED POURABLE AQUEOUS CLEANER

[75] Inventors: Clement K. Choy, Walnut Creek; Aram Garabedian, Jr., Fremont; Frederick I. Keen, Mantecca, all of Calif.

[73] Assignee: The Clorox Company, Oakland, Calif.

[ * ] Notice: The portion of the term of this patent subsequent to Mar. 29, 2011 has been disclaimed.

[21] Appl. No.: 21,645

[22] Filed: Feb. 22, 1993

Related U.S. Application Data

[63] Continuation of Ser. No. 703,582, May 20, 1991, abandoned, which is a continuation of Ser. No. 523,264, May 14, 1990, abandoned, which is a continuation of Ser. No. 176,603, Apr. 1, 1988, abandoned.

[51] Int. Cl.[5] ..... C11D 9/00

[52] U.S. Cl. ..... 252/108; 252/104; 252/133; 252/174.25; 252/DIG. 14; 252/162

[58] Field of Search ..... 252/96, 97, 98, 104, 252/115, 116, 123, 126, 133, 154, 155, 174.25, DIG. 14, 108, 162

[56] References Cited

U.S. PATENT DOCUMENTS

| | | | |
|---|---|---|---|
| 3,558,496 | 1/1971 | Zmoda | 252/95 |
| 3,884,826 | 5/1975 | Phares et al. | 252/106 |
| 3,931,033 | 1/1976 | Löhr et al. | 252/122 |
| 3,956,158 | 5/1976 | Donaldson | 252/102 |
| 3,981,826 | 9/1976 | Munro | 252/526 |
| 4,005,027 | 1/1977 | Hartman | 252/95 |
| 4,005,029 | 1/1977 | Jones | 252/99 |
| 4,051,056 | 9/1977 | Hartman | 252/99 |
| 4,116,851 | 9/1978 | Rupe et al. | 252/103 |
| 4,129,423 | 12/1978 | Rubin | 51/304 |
| 4,158,553 | 6/1979 | Chapman | 51/304 |
| 4,235,732 | 11/1980 | Beyer | 252/103 |
| 4,240,919 | 12/1980 | Chapman | 252/95 |
| 4,248,728 | 2/1981 | Puryear | 252/103 |
| 4,287,079 | 9/1981 | Robinson | 252/99 |
| 4,352,678 | 10/1982 | Jones et al. | 51/307 |
| 4,396,525 | 8/1983 | Rubin et al. | 252/174.25 |
| 4,414,128 | 11/1983 | Goffinet | 252/111 |
| 4,455,250 | 6/1984 | Frazier | 252/106 |
| 4,457,856 | 7/1984 | Mitchell et al. | 252/166 |
| 4,507,219 | 3/1985 | Hughes | 252/118 |
| 4,508,634 | 4/1985 | Elepano et al. | 252/163 |
| 4,533,487 | 8/1985 | Jones | 252/170 |
| 4,576,738 | 3/1986 | Colodney et al. | 252/559 |
| 4,599,186 | 7/1986 | Choy et al. | 252/102 |
| 4,657,692 | 4/1987 | Choy et al. | 252/99 |
| 4,676,920 | 6/1987 | Calshaw | 252/163 |
| 4,695,394 | 9/1987 | Coy et al. | 252/97 |
| 4,788,005 | 11/1988 | Castro | 252/539 |
| 4,842,757 | 6/1989 | Reboa et al. | 252/76 |
| 4,968,445 | 11/1990 | Ahmed et al. | 252/99 |
| 4,970,016 | 11/1990 | Ahmed et al. | 252/99 |
| 5,089,161 | 2/1992 | Ahmed et al. | 252/99 |
| 5,279,755 | 1/1994 | Choy et al. | 252/76 |
| 5,298,181 | 3/1994 | Choy et al. | 252/95 |

FOREIGN PATENT DOCUMENTS

| | | | |
|---|---|---|---|
| 126545 | 11/1984 | European Pat. Off. . | |
| 137616 | 4/1985 | European Pat. Off. | C11D 7/50 |
| 216416 | 4/1987 | European Pat. Off. | C11D 3/14 |
| 108499 | 6/1985 | Japan . | |
| 60-108499 | 6/1985 | Japan | C11D 3/14 |

OTHER PUBLICATIONS

18 Dec. 1989 Search Report, EP89303175.
18 Dec. 1989 Search Report, EP89303176.

*Primary Examiner*—Gary P. Straub
*Assistant Examiner*—Timothy C. Vanoy
*Attorney, Agent, or Firm*—Joel J. Hayashida; Michael J. Mazza; Harry A. Pacini

[57] ABSTRACT

This invention provides a thickened aqueous hard surface cleaner composition comprising colloidal alumina as the thickener in an aqueous cleaner which comprises a surfactant, electrolyte/buffer, soap and organic solvent system. These cleaner composition systems, which are the fluent, all-purpose type of cleaners, have surprising properties when thickened with the colloidal alumina. Such cleaners when thickened with colloidal alumina have a smoothly flowable or plastic consistency, and in their most preferred form, are pourable at room temperature, which consistency is not thixotropic in nature.

10 Claims, No Drawings

THICKENED POURABLE AQUEOUS CLEANER

Continuation of Ser. No. 07/703,582, filed May 20, 1991, now abandoned, itself a continuation of Ser. No. 523,264, filed May 14, 1990, now abandoned, itself a continuation of Ser. No. 07/176,603, filed Apr. 1, 1988, now abandoned.

FIELD OF THE INVENTION

The present invention relates to thickened aqueous hard surface cleaners and more particularly to such cleaners which are characterized by being smoothly flowable or plastic, preferably pourable at room temperature.

BACKGROUND OF THE INVENTION

Various hard surface cleaners or cleansers have been disclosed which contain soaps or surfactants in combination with various hydrocarbon type solvents. Examples of such cleansers are disclosed in U.S. Pat. Nos. 4,414,128 to Goffinet; 4,455,250 and 4,540,505 to Frazier; 4,533,487 to Jones and 4,576,738 to Calodney. In general these cleaners or cleansers are fluent, do not contain thickening agents and are not particularly adapted to have properties of thickened aqueous cleansers.

A variety of thickened aqueous scouring cleansers are known in the art and these cleansers exhibit various characteristics. For example in U.S. Pat. Nos. 4,599,186, 4,657,692 and 4,695,394 to Choy et al. and in U.S. Pat. No. 4,842,757, of Reboa et al. thickened aqueous abrasive cleansers are disclosed which use colloidal alumina thickeners to provide abrasive cleansers which exhibit little or no syneresis over time. Similar cleansers containing organic solvents are disclosed in commonly assigned U.S. Pat. No. 5,298,181, of Choy et al., whose grandparent application Ser. No. 07/176,636, filed Apr. 1, 1988, now abandoned, was filed on the same date as the greatgrandparent of this application herein, filed of even date with this application now abandoned.

Other abrasive cleansers are disclosed in U.S. Pat. No. 4,676,920 to Culshaw and publisher patent applications EP 126545 to Buzzaccarini and EP 216416 to Iding, which contain clay type thickeners While these cleansers contain hydrocarbon solvents, the clay thickeners do not provide the desired properties in terms of flowability and pourability. The disclosure of Iding indicates that including solvents in abrasive cleanser compositions contributes to the instability and syneresis of these cleansers.

Other abrasive cleansers are disclosed in U.S. Pat. Nos. 4,158,553 and 4,240,919 to Chapman, 4,396,525 and 4,129,423 to Rubin; 4,005,027 to Hartman; 4,457,856 to Mitchell; and Japanese Patent Application 60-108499 to Watanabe et al. None of these cleansers disclosed in these references provide the desired cleaning efficacy for certain applications together with the desired flowable or plastic consistency as exhibited by the Choy et al. cleansers. A specialized emulsion type skin cleaner composition for removing paint is disclosed in U.S. Pat. No. 4,508,643 to Elepano et al. as containing surfactants, solvents, an optional mild abrasive, and a protective colloid thickener, which protective colloid can be colloidal alumina.

The disclosures of the above patents, published applications and the copending applications are incorporated herein by reference.

In view of the above it has been found that there remains the need for a thickened aqueous cleaner having the characteristics of:

(a) having a smoothly flowable or plastic consistency, preferably pourable, and maintaining these properties over long periods of time; and (b) having improved cleaning efficacy for certain applications.

In the context of this invention the term "plastic" means that the cleaner is of a consistency which can undergo continuous deformation without rupture or relaxation of that consistency and the term "pourable" means that the cleaner is of a consistency which can be poured from an open container without the need for application of any force other than gravity, thus eliminating any need to shake, agitate or stir the cleaner before use.

SUMMARY OF THE INVENTION

It has now been determined that it is desirable to provide an aqueous cleaner containing an organic solvent characterized by having a thickened smoothly flowable or plastic, preferably pourable, consistency. It has surprisingly been found that a thickened aqueous cleaner having the desired thickened consistency can be made including a colloidal alumina thickener in a hydrocarbon solvent containing cleaner and, when used in combination with a fatty acid soap together with conventional electrolyte/buffers and surfactants, a cleaner is provided which has the above mentioned desirable properties of having a smoothly flowable or plastic, preferably pourable, consistency. This improved cleaner may also contain bleach when desired. This improved cleaner is described below in detail.

It is an object of the invention to provide a thickened aqueous cleaner characterized by a rheology and a consistency which remains smoothly flowable or plastic over long periods of time.

It is another object of this invention to provide a thickened aqueous cleaner characterized by having improved cleaning efficacy.

This invention provides a thickened aqueous hard surface cleaner characterized by being smoothly flowable or plastic comprising:

(a) at least one of an anionic, nonionic, amphoteric or zwitterionic surfactant being present in at least a cleaning-effective amount;

(b) an electrolyte/buffer forming about 0.1 to about 10% by weight of the cleaner;

(c) a fatty acid soap being present from an effective amount to about 5% by weight of the cleaner;

(d) an organic solvent present from a cleaning-effective amount to about 10% by weight of the cleaner; and (e) a colloidal alumina thickener having an average particle size, in dispersion, of no more than about one micron, the colloidal alumina thickener forming from about 1 to about 15% by weight of the cleaner.

The hard surface cleaner of the present invention as summarized above provides an excellent thickened consistency which aids in the ease of use of the cleaner on vertical surfaces. Because of the resulting consistency, cleaners provided by the present invention do not require shaking or agitation before use in order to pour formulation from a container. Rather, the cleaners of the present invention maintain a uniform rheology and have a smoothly flowable or plastic consistency and preferably a pourable consistency, preferably at room temperature, even after extended periods of shelf life. Accordingly, the cleaners of the present invention have substantial esthetic appeal while being useful in the sense of being easy to dispense and giving good coverage by flowing down while clinging to vertical surfaces.

In another aspect, this invention provides a method for preparing a thickened aqueous hard surface cleaner having a smoothly flowable or plastic consistency, preferably a pourable consistency, comprising the step of combining:

(a) at least one of an anionic, nonionic, amphoteric or zwitterionic surfactant being present in at least a cleaning-effective amount;
(b) an electrolyte/buffer forming about 0.1 to about 10% by weight of the cleaner;
(c) a fatty acid soap being present from an effective amount to about 5% by weight of the cleaner;
(d) an organic solvent present from cleaning-effective amount to about 10% by weight of the cleaner; and
(e) a colloidal alumina thickener having an average particle size, in dispersion, of no more than about one micron, the colloidal alumina thickener forming from about 1 to about 15% by weight of the cleaner.

In another aspect, this invention provides a method for cleaning a surface with a thickened, aqueous cleaner characterized by a smoothly flowable or plastic consistency, preferably pourable consistency, comprising contacting the surface having a stain thereon with the thickened, aqueous cleaner comprising:

(a) at least one of an anionic, nonionic, amphoteric or zwitterionic surfactant being present in at least a cleaning-effective;
(b) an electrolyte/buffer forming about 0.1 to about 10% by weight of the cleaner;
(c) a fatty acid soap being present from an effective amount to about 5% by weight of the cleaner.
(d) an organic solvent present from cleaning-effective amount to about 10% by weight of the cleaner; and
(e) a colloidal alumina thickener having an average particle size, in dispersion, of no more than about one micron, the colloidal alumina thickener forming from about 1 to about 15% by weight of the cleaner.

The present invention has surprisingly demonstrated the ability of the colloidal alumina in a surfactant, electrolyte/buffer, soap and organic solvent system to provide a cleaner which is smoothly flowable or plastic, preferably pourable, and provides superior cleaning properties.

DESCRIPTION OF EMBODIMENTS OF THE INVENTION

In one aspect, the present invention provides a thickened aqueous cleaner characterized by being pourable and having a smooth flowable consistency, these characteristics being retained by the cleaner even over long periods of time.

Accordingly, in at least one embodiment of the invention, a thickened, aqueous cleaner having desirable characteristics of a pourable and smooth flowing consistency comprises:

(a) at least one of an anionic, nonionic, amphoteric or zwitterionic surfactant being present from about 0.1 to about 10% by weight of the cleaner;
(b) an electrolyte/buffer forming from about 0.1 to about 10% by weight of the cleaner;
(c) a fatty acid soap being present from about 0.1 to about 5% by weight of the cleaner;
(d) an organic solvent present from about 0.1 to about 10% by weight of the cleaner; and
(e) a colloidal alumina thickener having an average particle size, in dispersion, of no more than about one micron, the colloidal alumina thickener forming about 1 to about 15% by weight of the cleaner.

The essential ingredient in the composition of the invention as summarized above is the colloidal alumina thickener in combination with the surfactant, the soap and the organic solvent, because this combination tends to provide the smoothly flowable or plastic (preferably pourable) consistency of the cleaner and not provide thixotropic characteristics.

In order to provide a more complete understanding of the invention, a summary as to each of the individual components in the composition of the present invention is set forth in greater detail below.

Surfactants

As mentioned herein above, the surfactants suitable for use in this invention are selected from anionic, nonionic, amphoteric, zwitterionic surfactants and mixtures thereof, which are in general the non-soap type of surfactants. It is especially preferred to use a combination of anionics and bleach-stable nonionics, which are usually more saturated to provide stability in the presence of the bleach. However, when the cleaners of this invention are used as non-bleach formulations, more unsaturation may be present in the surfactants selected.

The anionic surfactants useful in this invention can be selected from surfactants such as alkali metal alkyl sulfates, secondary alkane sulfonates, linear alkyl benzene sulfonates, and mixtures thereof. These anionic surfactants will preferably have alkyl chain groups averaging about 8 to about 20 carbon atoms. In practice, it is frequently desirable to have a bleach present in the cleaner. When the bleach is present, the surfactant can be any other anionic surfactant which does not degrade chemically when in contact with a hypohalite, e.g., hypochlorite, bleaching species. An example of a particularly preferred secondary alkane sulfonate is HOSTAPUR SAS, manufactured by Farbwerke Hoeschst A.G., Frankfurt, West Germany. Another example of an alkane sulfonate is Mersolat, which has an alkyl group of about 13–15 carbon atoms and is sold by Mobay Chemical Company. An example of typical alkali metal alkyl sulfates is Conco Sulfate WR, which has an alkyl group of about 16 carbon atoms, and is sold by Continental Chemical Company. When the electrolyte used is an alkali metal silicate, it is most preferable to include with the surfactant a soluble alkali metal soap of a fatty acid, such as a $C_{6-18}$, more preferably $C_{10-16}$, fatty acid soap. Especially preferred are sodium and potassium soaps of lauric and myristic acid.

Examples of preferred bleach-stable nonionic surfactants are amine oxides, especially trialkyl amine oxides. A representative structure is set forth below:

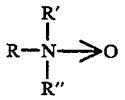

In the structure above, R′ and R″ can be alkyl of 1 to 3 carbon atoms, and are most preferably methyl, and R is alkyl of about 10 to about 20 carbon atoms. When R' and R'' are both $CH_3$— and R is alkyl averaging about 12 carbon atoms, the structure for dimethyldodecylamine oxide, a particularly preferred amine oxide, is obtained. These amine oxides can be straight or branched chain structures (see U.S. Pat. No. 4,299,313 to Joy) and can be functionalized when desired with various substituent groups, such as hydroxyethyl groups, ethoxylate groups and the like, which are compatible with the cleaner system and will provide the properties desired. Representative examples of these particular type of bleach-stable nonionic surfactants include the dimethyldodecylamine oxides sold under the trademark Ammonyx LO by Stepan Chemical Company, Chicago, Ill. Yet other preferred amine oxides are those sold under the trademark Barlox, by Baird Chemical Industries, Inc. Still others include the Conco XA series, sold by Continental Chemical Company, the Aromax series sold by Armour Industrial Chemical Company, the Schercamox series, sold by Scher Brothers, Inc., the Synprolam series sold by ICI Americas Inc., and the specialty amine oxides sold by Ethyl Corporation. These amine oxides preferably have main alkyl chain groups averaging about 10 to 20 carbon atoms. Other types of suitable surfactants include amphoteric surfactants, exemplary of which are betaines, imidazolines and certain quaternary phosphonium and tertiary sulfonium compounds. Particularly preferred are betaines such as N-carboxymethyl-N-dimethyl-N-(9-octadecenyl)ammonium hydroxide and N-carboxymethyl-N-cocoalkyl-N-dimethyl ammonium hydroxide, the latter of which is sold under the trademark Lonzaine by Lonza Corporation. Other acceptable surfactants are the zwitterionic surfactants exemplified in U.S. Pat. No. 4,005,029, to Jones (see columns 11–15), the disclosure of which patent is incorporated herein by reference.

It is preferred in some instances to combine at least two of these surfactants, most preferably the anionics and the bleach-stable nonionics. Combinations of these types of surfactants appear to be particularly desired when a bleach is present in the cleaner for maintaining hypochlorite half-life stability at elevated temperatures for long periods of time.

The surfactant is generally present in the cleaner in a range of about 0.1 to about 10% by weight, based on the total weight of the cleaner, more preferably about 0.5 to about 10% and most preferably about 1 to about 5%.

Electrolytes/Buffers

The electrolyte/buffer used in the present invention should be selected in combination with the surfactant or surfactants and the colloidal alumina thickener in order to produce the pourable and smooth flowing consistency desired for the composition of the present invention. In broad terms, electrolytes/buffers employed within the present invention are generally salts of various inorganic acids, including the alkali metal phosphates, polyphosphates, pyrophosphates, triphosphates, tetrapyrophosphates, silicates, metasilicates, polysilicates, carbonates, hydroxides, chlorides, sulfates and mixtures of the above. Certain divalent salts, for example, alkaline earth phosphate, carbonate, hydroxide, etc., salts can function singly as buffers. If such compounds were used, they normally would be combined with at least one other appropriate electrolyte/buffer to provide the appropriate pH adjustment. It may also be desirable to use as a buffer such materials as aluminosilicates (zeolites), borates, aluminates and bleach-stable organic materials such as gluconates, succinates, maleates, and their alkali metal salts. These electrolytes/buffers function, particularly in bleach containing formulation, to maintain the pH range of the inventive cleaner compounds preferably above 7.0, more preferably above 8.0 or 9.0 and most preferably at between about 10.0 and 13.0. The amount of electrolyte/buffer employed with the composition of the present invention can vary from about 0.1% to about 15% by weight of the cleaner, preferably from about 0.5 to about 10% and more preferably from about 1 to about 5%.

The silicate electrolytes/buffers useful in the present invention are formed by a combination of sodium oxide and silicon dioxide and may preferably be a sodium silicate having a weight ratio of silicon dioxide to sodium oxide of about 3.75/1 and about 1/1, preferably between about 3/1 and about 1.5/1. More preferably, the electrolyte/buffer is in the form of sodium silicate having a weight ratio of silicon dioxide to sodium oxide of about 2.4/1.

A silicate as described above is available, for example, from the PQ Corporation, Philadelphia, Pa.

Fatty Acid Soap

The soap useful in the present invention can be straight chain or branched chain fatty acids having 6 to 24 carbon groups with univalent or multivalent cations which render the soap soluble or dispersible in the aqueous cleaner. The soap may be an alkali metal salt of such a fatty acid, such as Li, Na or K, or may be ammonium or alkylammonium salts thereof. Soaps which are conventionally used as suds suppressors will generally be useful in the present invention. While soaps are selected for use in prior art cleaners for either suds control or for bleach stability, it is also important in the present invention that the soap be compatible with and solubilize the organic solvent in the cleaner of the present invention, and also be compatible with the colloidal alumina thickener in the cleaner of the present invention. The soap which may be saturated or unsaturated, provides in combination with the alumina colloid thickener and hydrocarbon solvent, the characteristics of improved cleaning properties while still maintaining the plastic consistency or pourable flow characteristics of the cleaner of this invention. As indicated above relative to the surfactants, a saturated soap is usually preferred when a bleach is present in order to maintain bleach stability, but an unsaturated soap may be preferred in some instances when a bleach is not included in the cleaner of the present invention.

The soap useful in the present invention is generally limited to a molecular weight range characterized by having from about 8 to about 20 carbon groups, either in a straight or branched chain configuration. More preferably, the soap is of a type having from about 10 to about 18 carbon groups, even more preferably about 12 to about 14 carbon groups. The amount of soap employed in a cleaner according to the present invention will be from an effective amount to about 5% by weight of the cleaner, preferably from about 0.1 to about 5%, more preferably from about 0.5 to about 4% and most preferably up to about 3%.

Suitable fatty acid soaps useful in the present invention may be selected from the class consisting of potassium laurate, sodium laurate, sodium stearate, potassium stearate, sodium oleate, etc. Similar soaps containing ammonium ion as a cation may also be used particularly if the cleaner does not contain a bleach. Suitable soaps for use within the present invention are disclosed in Chemical Publishing Co., Inc., Encyclopedia of Surface-Active Agents, Vol. I (1952), page 39 etc., Kirk-Othmer, Encyclopedia of Chemical Technology 3d, Vol. 21 pp. 162–181 re "Soaps" and Vol. 22, re "Surfactants". Accordingly, those references are incorporated herein as though set out in full.

The manner in which the fatty acid anionic surfactant or soap functions in combinations with the colloidal alumina thickener and the hydrocarbon solvent according to the present invention is not fully understood. It is believed that the soap may aid in solubilizing the organic solvent present in the cleaners of the present invention because it probably helps to mix or emulsify the solvent.

Organic Solvents

The organic solvents useful in the present invention are alkyl or aryl hydrocarbons containing at least 2 carbon atoms, preferably about 4 to about 18 carbon atoms and can include ethers, alcohols, esters, ketones and other hydrocarbons which are compatible with the fatty acid soap surfactant and colloidal aluminum present in the composition of the cleaner of the present invention. Examples of such organic solvents include d-limonene, terpinolene, pine oil, glycol ethers such as butoxyethanol (butyl "Cellosolve"), straight or branched chain glycol ethers; glycols, such as polyethylene glycol; alcohols such as phenol, ethyl alcohol, benzyl alcohol, geraniol, citronellol, santalol, menthol, borneol, carveol, ethylhexelcarbonyl, vetiverol, linalol, terpineol, myrcenol, cetrol; and esters such as linalyl acetate, benzyl acetate, isobornyl acetate, ethyl acetoacetate and isoamylacetate. Other examples of organic solvents which may be useful in the cleaners of the present invention include saturated derivatives of terpenes, isoprenes, mineral spirits, such as the Isopar and Norpar series of mineral spirits and mineral oils sold by Exxon Corporation, and mineral oils, such as available from Penseco Company. Of course, mixtures of various organic solvents are useful in the cleaners of the present invention.

As understood with respect to the surfactants and soaps, saturated organic solvents should be used when a bleach is included in the cleaners of this invention to promote bleach stability as recognized by those skilled in the art. Conversely, unsaturated organic solvents may be selected for use in the non-bleach formulations of the cleaners of this invention. Moreover, it is further understood that the organic solvent is selected to be compatible with the soap and surfactant useful in the present invention as outlined above.

The amount of organic solvent employed in the cleaner according to the present invention will be from an effective amount up to about 10% by weight of the cleaner, preferably from about 0.1 to about 8%, more preferably from about 0.1 to about 6%, and most preferably up to about 4%. In addition, it appears desirable in the present invention that the ratio of organic solvent to the combined amount of soap and surfactant generally be within certain ranges for most practical formulation. In general, the weight ratio of organic solvent to soap plus surfactant should be less than about 1:40, and usually between about 10:1 and about 1:20, preferably between about 2:1 and about 1:10, more preferably between about 1:1.5 and about 1:9, still more preferably between about 1:2 and about 1:8, and most preferably between about 1:3 and about 1:7.

Colloidal Alumina Thickener

The colloidal alumina thickener component of the present invention is preferably a hydrated aluminum oxide having qualifying characteristics such as particle size to cause it to function as a colloidal thickener. In this sense, the colloidal alumina thickener used in the invention is to be contrasted from abrasive alumina materials having substantially larger particle sizes, for example substantially greater than one micron. Accordingly, the particle size of the colloidal alumina thickener is a particularly important feature for that component of the invention.

Preferred hydrated aluminas within the present invention are derived from synthetic Boehmites. Of greater importance, the hydrated colloidal alumina thickener of the present invention is chemically insoluble, that is, it should not dissolve in reasonably acidic, basic or neutral media. However, it is noted that colloidal alumina will dissolve in strongly alkaline media, for example, 50% NaOH.

A typical alumina is distributed by Remet Chemical Corp., Chadwicks, N.Y., under the trademark DISPERAL (formerly DISPURAL) and manufactured by Condea Chemie, Brunsbuettel, West Germany. DISPERAL is an aluminum oxide monohydrate which commonly forms stable colloidal aqueous dispersions. Alumina products of this type commonly exist as dry powders which can form thixotropic gels, bind silica and other ceramic substrates, while possessing a positive charge and being substantive to a variety of surfaces.

DISPERAL has a typical chemical composition of 90% alpha aluminum oxide monohydrate (Boehmite) 9% water, 0.5% carbon (as primary alcohol), 0.008% silicon dioxide, 0,005% ferric oxide, 0,004% sodium silicate, and 0.05% sulfur. It has a surface area (BET) of about 320 $m^2/gm$, an undispersed average particle size (as determined by sieving) of 15% by weight being greater than 45 microns and 85% being less than 45 microns, an average particle size, in dispersion, of 0.0048 microns as determined by X-ray diffraction, and a bulk density of 45 pounds per cubic foot (loose bulk) and 50 pounds per cubic foot (packed bulk). Yet another alumina suitable for use within the present invention, although not as preferred, is manufactured by Vista Chemicals Company, Houston, Tex. and sold under the trademark CATAPAL alumina. CATAPAL has a typical chemical composition of 74.2% aluminum oxide (Boehmite), 25.8% water, 0.36% carbon, 0,008% silicon dioxide, 0.005% ferric oxide, 0,004% sodium oxide and less than 0.01% sulfur. It has a surface area (BET) of 280 $m^2/gm$, an undispersed average particle size (as determined by sieving) of 38% by weight being less than 45 microns and 19% being greater than 90 microns.

These colloidal alumina thickeners, used in dispersed form in the invention, generally have exceedingly small average particle size in dispersion (i.e., generally less than one micron). In point of fact, the average particle size diameter of these thickeners when dispersed is likely to be around 0.0048 micron. Thus, a preferred average particle size range in dispersion is preferably less than one micron, more preferably less than about 0.5 micron and most preferably less than 0.1 micron. Due to their small particle size, little or substantially no abrasive action is provided by these types of thickeners even though they are chemically insoluble, inorganic particles. Additionally, these colloidal aluminas are chemically quite different from aluminum oxide abrasives, such as corundum. Colloidal aluminas are produced from synthetic Boehmite. In general, they are synthesized by hydrolyzing aluminum alcoholates, with the resulting reaction products being hydrated aluminum (colloidal alumina) and three fatty alcohols. The reaction equation is set forth below:

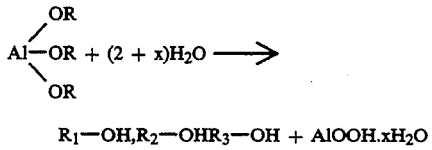

$$Al(OR)_3 + (2 + x)H_2O \longrightarrow R_1{-}OH, R_2{-}OHR_3{-}OH + AlOOH.xH_2O$$

(From Condea Chemie, "PURAL PURALOX DISPERAL High Purity Aluminas" Brochure (1984), the contents of which are herein incorporated by reference. )

These hydrated aluminum oxides are called synthetic Boehmites merely because their crystalline structure appears similar to that of naturally occurring Boehmite. Boehmite, which is the actual mineral, has a Mohs hardness of about 3. It thus may be expected that the synthetic Boehmite would not have a hardness greater than the naturally occurring Boehmite. Corundum, on the other hand, appears to have a Mohs hardness of at least 8 and perhaps higher. Thus, any abrasive action provided by colloidal aluminum oxides may be severely mitigated due to their relative softness. An important aspect of the hydrated aluminas used herein is that they should be chemically insoluble, i.e., should not dissolve in acidic, basic or neutral media in order to have effective thickening as well as stability properties. However, colloidal Boehmite aluminas will dissolve in highly basic media, e.g., 50% NaOH.

A further important point is that these colloidal alumina thickeners, in order to be useful as thickeners in the cleaners of this invention, must be initially dispersed in aqueous dispersion by means of strong acids. Preferable acids used to disperse these colloidal aluminas include, but are not limited to, acetic, nitric and hydrochloric acids. Sulfuric or phosphoric acids are not preferred.

Generally, a 1–50%, more preferably are about 5–40%, and most preferably about 10–35% dispersion is made up, although in some instances, percentages of colloidal alumina are calculated for 100% (i.e., as if non-dispersed) active content. In practice, the colloidal alumina may be added to water sufficient to make up the desired percent dispersion and then the acid may be added thereto. Or, the acid may be first added to the water and then the colloidal alumina is dispersed in the dilute acid solution. In either case, a substantial amount of shearing (i.e., mixing in a mixing vat) is required to obtain the proper rheology.

Usually, a relatively small amount of concentrated acid is added. For instance, for a 25 wt.% dispersion material, 25% alumina monohydrate is combined with 1.75% concentrated (12M) hydrochloric acid and then dispersed in 73.75% water. The colloidal alumina thickener itself is generally present in the cleaner in the range of about 1 to about 15% by weight based on the total weight of the cleaner, preferably about 1 to about 10%, more preferably about 1 to 6%, and most preferably, about 1 to about 5.5. Many useful formulations will contain from about 2.5 to about 5% colloidal alumina according to the present invention.

Neutralization of the acidified dispersed colloid is necessary to obtain the desired, finished product rheology (i.e., it thickens). Thus, the acidified, diluted colloid is neutralized, preferably by sodium hydroxide (e.g., a 50% solution), although if the electrolyte/buffer is sodium carbonate or sodium silicate, it may be possible to forego the sodium hydroxide as a separate component. Secondly, since a halogen bleach may be added, if desired, to the cleaners of this invention, and such bleaches are unstable in the presence of acid, neutralization is also desirable when a bleach is used.

With respect to thickening, it should be noted that while there are many types of inorganic and organic thickeners, not all will provide the proper type of plastic, flowable rheology desired in the present invention, particularly the preferred pourable consistency. Common clays, for instance, those used in U.S. Pat. Nos. 3,985,668 and U.S. Pat. 3,558,496, will likely lead to a false body rheology. False body rheology pertains to liquids which, at rest, turn very viscous, i.e., form gels. Problematic with such false body liquids is that they appear to tend to thicken very rapidly and harden or set up so that flowability is a problem. A thixotropic rheology is also not particularly desirable in this invention since in the thixotropic state, a liquid at rest also thickens dramatically, but, theoretically, should flow upon shearing. If the thixotrope has a high yield stress value, as typically found in clay-thickened liquid media, the fluid at rest may not re-achieve flowability without shaking or agitation. As a matter of fact, if colloidal alumina alone is used to thicken the liquid cleaners of this invention, a thixotrope with high yield stress values appears to result. This type of product is less preferred, and therefore, the surfactants included in the formulas of this invention are crucial towards achieving a desired creamy, flowable, plastic rheology, particularly the preferred pourable consistency. Ordinarily, a thixotrope will flow from a dispenser only upon shaking or squeezing. An example of a typical thixotrope is catsup, which sometimes requires quite a bit of shaking and pounding of the bottom of the bottle containing it to induce flow.

The type of rheology desired in this invention is a plastic, flowable rheology. This sort of rheology does not require shearing to promote fluidity. Thus, a product made in accordance with the present invention will not require, in its preferred form, squeezing (assuming a deformable plastic squeeze bottle), shaking or agitation to flow out of the container or dispenser, but will have a pourable consistency. In a non-preferred form, the cleaners of the present invention may not be pourable from a particular container, but nevertheless are a smoothly flowable, plastic consistency and are not thixotropes.

Attaining this rheology in the cleaners of the present invention containing organic solvents was surprising since it has been thought that the combination of thickeners in cleaners containing organic solvents would result in a different rheology. It was also surprising that cleansers such as in Choy et al. U.S. Pat. No. 4,695,394, which are thickened and stabilized with colloidal alumina, would have such plastic rheology and also such abrasive-suspending stability so as to not become unstable when organic solvents were included in such compositions in accordance with the invention in co-pending application Ser. No. 07/176,636 (BDSM 006270-017) filed of even date with this application. Moreover, nothing in the art had ever disclosed that fluent, solvent-containing household hard surface cleaners could be thickened with colloidal alumina to a flowable or plastic, preferably pourable, consistency.

Other Ingredients

As mentioned above, the cleaners of the present invention can, when desired, contain a bleach. A source of bleach is selected from various halogen bleaches. For the purposes of the present invention, halogen bleaches are particularly favored. As examples thereof, the bleach can be selected from the group consisting essentially of the alkali metal and alkaline earth salts of hypohalite, hypohalite addition products, haloamines, haloimines, haloimides and haloamides. These also produce hypohalous bleaching species in situ with hypochlorites being a preferred form of bleach. Representative hypochlorite producing compounds include sodium, potassium, lithium and calcium hypochlorite, chlorinated trisodium phosphate dodecahydrate, potassium and sodium dichloroisocyanurate, trichloroisocyanuric acid, dichlorodimethyl hydantoin, chlorobromo dimethylhydantoin, N-chlorosulfamide, and chloramine.

As noted above, a preferred bleach employed in the present invention is sodium hypochlorite having the chemical formula NaOCl, in an amount ranging from about 0.1% to about 5%, more preferably about 0.25% to 4% and most preferably 0.5% to 2.0%. The purpose for the bleach is evident in forming an oxidizing cleaning agent which is very effective against oxidizable stains such as organic stains.

A principal problem with the use of bleach in such compositions is its tendency to be unstable or to cause instability of other components, particularly certain surfactants if they are present in substantial amounts. In any event, because of the use of colloidal alumina as a thickener in the present invention together with a fatty acid soap, a surfactant, and organic solvent together with only limited amounts of additional surfactant components, the bleach stability of the composition of the present invention (expressed in half-life stability) is surprisingly good resulting in a product capable of maintaining excellent flow characteristics and bleach strength even after considerable periods of shelf life.

Abrasives may be added to the cleaners of the present invention to form scouring abrasive cleansers. The abrasives suitable for use and the useful amounts thereof are disclosed in copending application Ser. No. 07/176,636 (BDSM 006270-017) filed of even date with this application. As stated above in the Background section, this co-pending application disclosure is incorporated herein by reference. The cleaners of the present invention are particularly suited to inclusion of abrasives, because the colloidal alumina/surfactant/soap/organic solvent system of the present cleaners provide stable suspensions of abrasives therein to provide scouring cleansers. The cleaners of the present invention may contain small amounts of fine or mild abrasives to enhance cleaning efficacy for some applications, without producing a scouring action typical of many abrasive cleansers.

In addition to the components for the cleaning composition of the present invention as set forth above, further desirable adjuncts may include bleach-stable dyes (for example, anthraquinone dyes), pigments (for example, phthalocyanine, $TiO_2$ and ultramarine blue), colorants and fragrances in relatively low amounts, for example, about 0.001% to 5.0% by weight of the cleaner composition.

Water

Water is the medium used as the medium in which the various components of the cleaner of the present invention are dissolved, dispersed or mixed. Some of these components may be added to the cleaner in a water base, thus contributing to the total water present in the cleaner. While water and the miscellaneous minor ingredients or additives make up the remainder of the composition, water is generally present in amounts ranging from about 10 to about 90% by weight of the cleaner.

Method of Preparing

As previously mentioned, the method of preparing the liquid cleaner of this invention comprises combining:

(a) an initial portion of the total water with a colloidal alumina thickener;
(b) a final portion of the total water and a discrete amount of a neutralizing agent;
(c) optionally, a halogen bleach;
(d) a fatty acid soap;
(e) a surfactant (bleach stable nonionic when a bleach is used);
(f) a buffer/electrolyte which interacts with the surfactants recited in steps (d) and (e) and the thickener recited in step (a) to result in a plastic rheology; and
(g) an organic solvent.

As similarly described in U.S. Pat. No. 4,657,692 at column 13, the disclosure of which patent is incorporated herein by reference, to produce the cleaner, alumina is charged into a vat or suitable mixing vessel which has been provided with a suitable mixing means, such as an impeller, which is in constant agitation with suitable angular velocity. The alumina is acidified and diluted with about 50% of the total water used. An alkyl benzene sulfonate phase stabilizer can be optionally added at this point. A neutralizer, such as a 50% NaOH solution, can be added with the remainder of the water. Next, optional ingredients, such as halogen bleach, abrasives, dyes, fragrances, etc., can be added, if desired. Thereafter, the anionic surfactants are added. When silicate is used as the electrolyte/buffer, it is necessary to have a fatty acid soap as one of the anionic surfactants since, as explained in U.S. Pat. No. 4,695,394, the soap appears to surprisingly break up any network which could form between the silicate and the colloidal alumina. Next, the bleach-stable nonionic surfactant is added, which is generally a trialkyl amine oxide (although a betaine or other surfactant would likely be suitable). At this point any alkyl benzene sulfonate is most preferably, although optionally, added. The electrolyte/buffer is then added and finally, the organic solvent is added. Alternatively, the organic solvent can be premixed with surfactants if desired. Note that at virtually any step in this method, the optional minor ingredients, such as fragrance and pigments could be added. However, since fragrance is an organic component which may be more susceptible to oxidation by the halogen bleach, it is preferable to add it last when a bleach is present.

The invention is further illustrated by the embodiment set forth below:

EXAMPLE

The following embodiment illustrates the thickened cleaner of the present invention containing surfactant, soap and an organic solvent, thickened with colloidal alumina.

| Material | Wt. % |
|---|---|
| Water | 71.06 |
| HCl (38% | 0.21 |
| Disperal[1] | 4.50 |
| Pigment | 0.75 |
| Tergitol[2] | 2.70 |
| LAS[3] | 2.80 |
| SAS[4] | 2.65 |
| Soap Solution[5] | 7.33 |
| Sodium Chloride | 2.00 |
| Terpinolene[6] | 3.00 |
| Silicate RU[7] | 3.00 |
| | 100.00 |

[1]Alumina ($Al_2O_3.H_2O$) from Condea Chemie.
[2]Tergitol TMN-6 from Union Carbide.
[3]Biosoft LAS 40-S(40%) from Stepan Chemical Company.
[4]Hostapur SAS, secondary alkane sulfonate from Hoechst A.G.
[5]Soap solution prepared from 13.62 parts by weight lauric acid, 13.62 parts 50% NaOH and 72.75 parts water.
[6]From SCM Aroma and Flavor Chemicals.
[7]Sodium silicate RU from PQ Corporation.

The above cleaner composition has a viscosity of 1,720 cps (Brookfield RVT, spindle No. 4, 5 rpm, room temperature). It also exhibits the properties of being smoothly flowable and pourable at room temperature, thus making it particularly useful as a thickened aqueous cleaner.

The present invention also contemplates methods for forming cleaners including compositions such as those described above and illustrated by the various examples. Generally, such a method comprises the steps of combining the various components to form the cleaner composition.

The present invention also contemplates methods for cleaning hard surfaces or removing soil in a manner believed obvious from the preceding description. However, to assure a complete understanding of the invention, such a method is carried out by contacting the surface, stain or soil with a composition according to the present invention. Thereafter, the composition together with the suspended stain is preferably removed from the surface by rinsing.

Accordingly, there has been disclosed above a number of embodiments and examples for a thickened aqueous cleaner particularly characterized by a smoothly flowable or plastic consistency while demonstrating the ability to resist syneresis. While preferred embodiments and examples of the invention have been illustrated and described above, it is to be understood that these embodiments are capable of further variation and modification; therefore, the present invention is not to be limited to precise details of the embodiments set forth above but is to be taken with such changes and variations as fall within the purview of the following claims.

We claim:

1. A thickened aqueous hard surface cleaner characterized by being smoothly flowable or plastic, comprising:

(a) at least one of an anionic, nonionic, amphoteric or zwitterionic surfactant being present in a cleaning-effective and abrasive-suspending amount;

(b) an electrolyte/buffer forming about 0.1 to about 10% by weight of the cleanser;

(c) a fatty acid soap being present from about 0.1 to about 5% by weight of the cleaner;

(d) either terpene hydrocarbon, $C_{4-8}$ ester or $C_{4-18}$ ether, as the sole organic solvent present from an effective amount to about 10% by weight of the cleaner;

(e) a colloidal alumina thickener having an average particle size, in dispersion, of no more than about one micron, the colloidal alumina thickener forming about 1 to about 15% by weight of the cleanser; and (f) the remainder being water.

2. The cleaner of claim 1 wherein the colloidal alumina thickener has a maximum particle size in dispersion of not more than about 0.1 micron.

3. The cleaner of claim 1 wherein the surfactant comprises an anionic surfactant.

4. The cleaner of claim 1 wherein the fatty acid soap is an alkali metal fatty acid soap.

5. The cleaner of claim 4 wherein the anionic surfactant is monovalent.

6. The cleaner of claim 1 wherein the fatty acid soap comprises from about 0.1 to about 4% by weight of the cleanser.

7. The cleaner of claim 1 wherein the terpene organic solvent comprises from about 0.1 to about 7% of the cleanser.

8. The cleaner of claim 1 further comprising hypochlorite bleach.

9. The cleanser of claim 1 characterized by being pourable.

10. A method for cleaning a surface with a thickened aqueous cleaner characterized by having a smoothly flowable or plastic consistency comprising contacting the surface having a stain thereon with a thickened aqueous cleaner comprising:

(a) at least one of an anionic, nonionic, amphoteric or zwitterionic surfactant being present in a cleaning-effective amount;

(b) an electrolyte/buffer forming about 0.1 to about 10% by weight of the cleaner;

(c) a fatty acid soap being present from about 0.1 to about 5% by weight of the cleanser;

(d) either terpene hydrocarbon, $C_{4-18}$ ester or $C_{4-18}$ ether, as the sole organic solvent present from a cleaning-effective amount to about 10% by weight of the cleaner;

(e) a colloidal alumina thickener having an average particle size, in dispersion, of no more than about one micron, the colloidal alumina thickener forming about 1 to about 15% by weight of the cleaner;

(f) the remainder being water.

* * * * *